United States Patent [19]

Meratti

[11] Patent Number: 4,639,177

[45] Date of Patent: Jan. 27, 1987

[54] BOOK SEWING MACHINE WITH AUTOMATIC SEPARATION OF BOOKS

[75] Inventor: Gianattilio Meratti, Carona, Switzerland

[73] Assignee: Meccatec S.p.A., Torre de' Roveri, Italy

[21] Appl. No.: 654,447

[22] Filed: Sep. 26, 1984

[30] Foreign Application Priority Data

Sep. 27, 1983 [IT] Italy ..... 67998 A/83

[51] Int. Cl.[4] ..... B42C 19/04; B42C 19/08

[52] U.S. Cl. ..... 412/11; 83/371; 83/614; 83/925 A; 270/95; 412/2; 412/13; 412/16; 412/25; 414/330

[58] Field of Search ..... 412/1, 2, 9, 11, 14, 412/16, 13, 33, 25; 83/371, 614, 925 A; 270/21, 52, 52.5, 95; 221/232; 414/330, 592

[56] References Cited

U.S. PATENT DOCUMENTS

| | | | |
|---|---|---|---|
| 9,872 | 7/1853 | Hesse | 83/614 |
| 3,205,739 | 9/1965 | Meyer-Jagenberg | 270/95 |
| 3,277,761 | 10/1966 | Dreher | 83/614 |
| 3,391,866 | 7/1968 | Geis et al. | 414/330 |
| 3,708,094 | 1/1973 | Koether | 225/103 |
| 4,480,517 | 11/1984 | Miyamoto | 83/614 |

FOREIGN PATENT DOCUMENTS

| | | | |
|---|---|---|---|
| 582200 | 8/1933 | Fed. Rep. of Germany . | |
| 612818 | 5/1935 | Fed. Rep. of Germany . | |
| 2244681 | 3/1973 | Fed. Rep. of Germany | 414/330 |
| 389573 | 7/1965 | Switzerland . | |

*Primary Examiner*—Robert L. Spruill
*Assistant Examiner*—Taylor J. Ross
*Attorney, Agent, or Firm*—Sughrue, Mion, Zinn, Macpeak & Seas

[57] ABSTRACT

A book sewing machine has an inserter for plates for indicating the planes of separation between the books. Each plate is disposed in the separation plane in correspondence with the top of the adjacent face of the contiguous books on that side of the books facing the loader. The machine also has a gluer for applying a layer of glue to the backs of the books which advance towards the discharge zone. Close to the latter is a separator constituted by a cutting blade which traverses the pile of books so that it cuts the layer of glue on the backs and simultaneously cuts the thread connecting the last book to the next book, thus effecting the separation. An operating cycle of the separator device is started each time a control circuit is given an enabling signal by a detecting device for detecting the passage of a plate. The position of the detection device preferably coincides with that of the cutting blade which may be a separate element or which may be part of the plate.

17 Claims, 10 Drawing Figures

BOOK SEWING MACHINE WITH AUTOMATIC SEPARATION OF BOOKS

Figure 1:
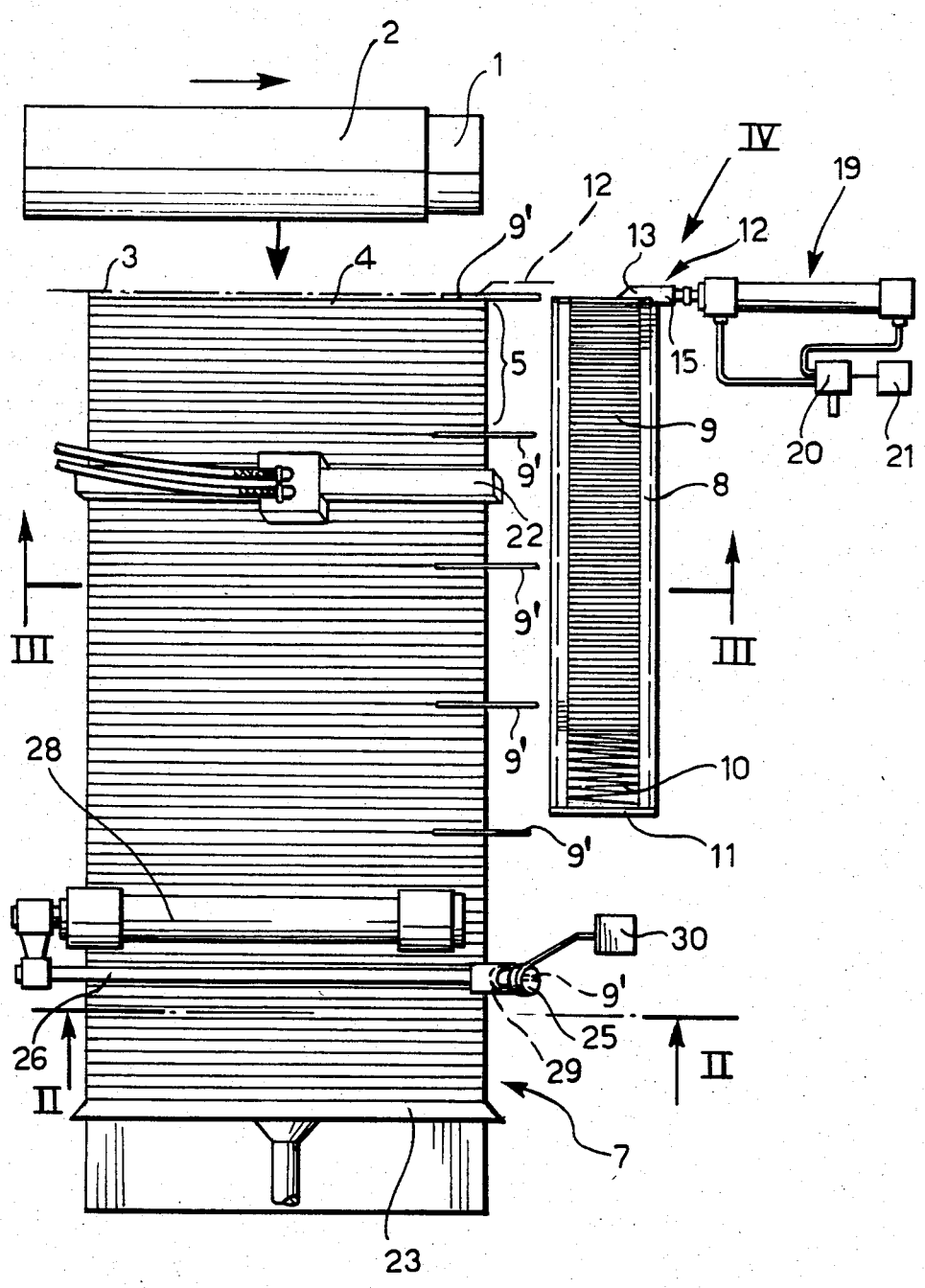

The present invention relates to a book sewing machine.

Such machines are well known and generally carry out the sewing in two ways: with or without a blind stitch. In both systems it is necessary to cut the sewing threads before one proceeds to separate the books already sewn,which are carried towards the discharge zone of the machine by a horizontal conveyor.

For this purpose the sewing machines are equipped with a thread cutting device which grasps and cuts the thread in correspondence with the parts of the stitching which connect the final signature of one book to the first signature of the successive book.

In both cases for each type of stitching, the part of the thread which joins two successive books must be unstitched during the separation of the books, being made to pass through two necks existing between the loops of the chain of this stitching and the backs of the rear signature of a book and the first signature of the successive book.

The separation of the books is generally carried out manually by an operator when the books are discharged from the sewing machine.

As long as one is considering very thick books formed by more than twenty signatures, manual separation is easy and the time required for the operation has no significant effect on the overall time for sewing a book.

When, however, the number of signatures per book is less than that mentioned above (books formed by only three signatures are fairly common), then the fewer the number of signatures per book the more the production rate is reduced.

The operator loses a great deal of time overall in the separation and is thus obliged to slow the speed of the sewing machine.

The sewn books, once separated, in general always by manual operations, piled and palletized are sent to the back glueing machine.

Since the sewing machine cannot, because of the cuts necessary to enable the separation, adequately establish the form of the books so that they are able to withstand the manual handling described above, it is usual to apply a filament of glue along the entire back at the first and the penultimate signature of each book in order to make it more resistant to deformation.

At the back glueing machine, a second operator loads the books and the machine feeds them one at a time and spreads a layer of glue on the back of each book. This glue is dried by leaving the book in the machine for the requisite period of time after which the machine itself sends the books to an automatic trilateral paper cutting machine for the trimming of the three free sides of the book.

The known systems outlined above have numerous disadvantages, among which are:

that of slowing the working rate when sewing books composed of a few signatures (the disadvantage is accentuated when the sewing machine is of the type which sews with blind stitches);

the need to subject the operator to the repetitive and fatiguing task of separating the books by unstitching the threads which connect them which distracts him from overseeing the other operations of the sewing machine;

insufficient stability of form of the books which are sent to the back glueing machine ;

the fact that portions of thread project from the end signatures of the books along the zones in which the various stitches extend and these must be removed during subsequent operations, and finally the fact that it is necessary to send the book discharged from the sewing machine to the glueing machine before it passed to the trilateral paper cutting machine in each case.

The object of the present invention is in general to eliminate the said disadvantages and, since these are due to the manual system of separating the books, the invention tackles the problem of converting a book sewing machine of conventional type into a sewing machine having means for effecting the separation automatically, in synchronism with the operation of the members which carry out the sewing making use of simple devices Subordinately, the invention also tackles the problem of forming the said means so as to allow the books which leave the sewing machine to have a stability of form sufficient to enable them to be sent directly to the trilateral paper cutting machine and thus eliminate the need for the use of a back gluer thereby reducing the plant costs and the operating costs of the production line including the sewing machine.

According to the present invention the first of the problems indicated above is solved by providing a book sewing machine of the type for chain sewing, characterised in that it has an automatic mechanism for separating the books which have already been sewn, which includes:

a separator member arranged to be inserted between two contiguous books located close to the zone of discharge of the books which have been sewn, and arranged to be displaced in a vertical transverse plane relative to the direction of advance of the conveyor carrying a horizontal pile of the said books towards the said discharge zone from one side to the other of the said pile, under the action of a drive device;

a control system including:

(a) a marker device arranged to overlie the final signature of each book which is at the sewing zone close to the top of one of the respective vertical sides, an indicator element and (b) a sensor located close to the path of the indicator element traveled during the advance of the books towards the discharge zone as to to detect the passage of the indicator element itself and to start the working cycle of the drive device for controlling the separator member when the interval between the backs of the contiguous signatures of the books which must be separated is in the said transverse plane in which the separator member moves.

According to the preferred embodiment, the separator member is in the form of an elongate element inclined to the horizontal plane in which the backs of the books carried by the conveyor lie, so that its lower end is closer to the pile of books is a small distance from the upper corresponding corner of the pile itself; the element being slidable axially downwardly and fixed to the movable element of a linear motor movable towards the opposite side of the pile of books under the action of a second linear motor; the operating cycle of the motors being started by the pulse which the sensor emits on passage therepast of one of the indicators inserted between the contiguous books.

This elongate element may also be constituted by a simple rod or the like intended to fulfill solely the function of separating the books by the unstitching of portions of the threads already cut which connect them.

Alternatively the elongate element may be shaped in the form of a cutting blade and the sewing machine which in this case does not have a conventional cutter may conveniently be provided with a glue spreader of known type arranged to apply a layer of glue to the backs of the sewn books which is then cut during separation of the books by the cutting blade. This system is particularly advantageous in that it gives the books which leave the sewing machine a stability of form which is adequate to allow them to be sent directly to the trilateral paper cutter, allowing the back gluer to be omitted from the production line.

The books which leave the sewing machine are also without the threads which normally project from opposite longitudinal sides of the respective backs.

In both cases the function of the operator is greatly alleviated and the causes which necessitate the slowing of the production rate are completely eliminated in the case of the sewing of books composed of less than 20 signatures. This makes the use of the sewing system with blind stitches effectively superfluous.

Figure 2:
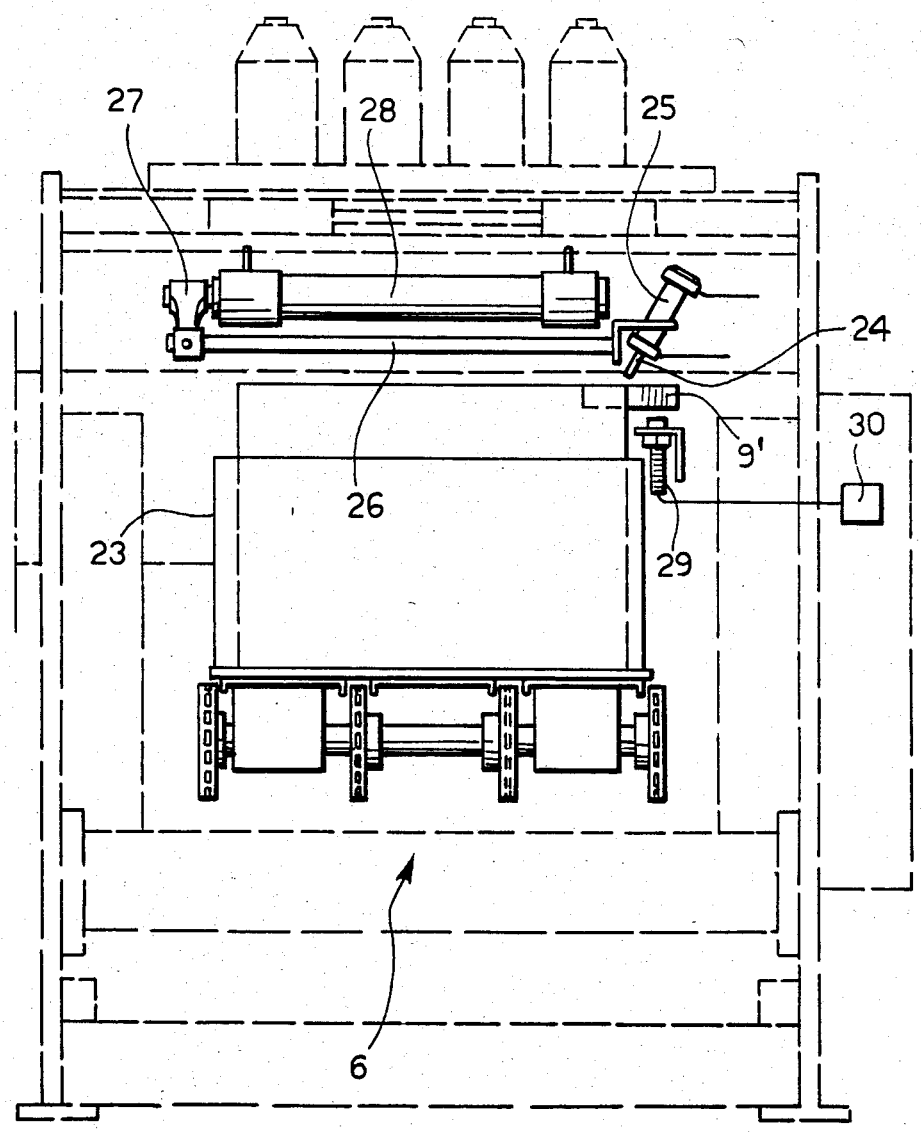
Figure 3:
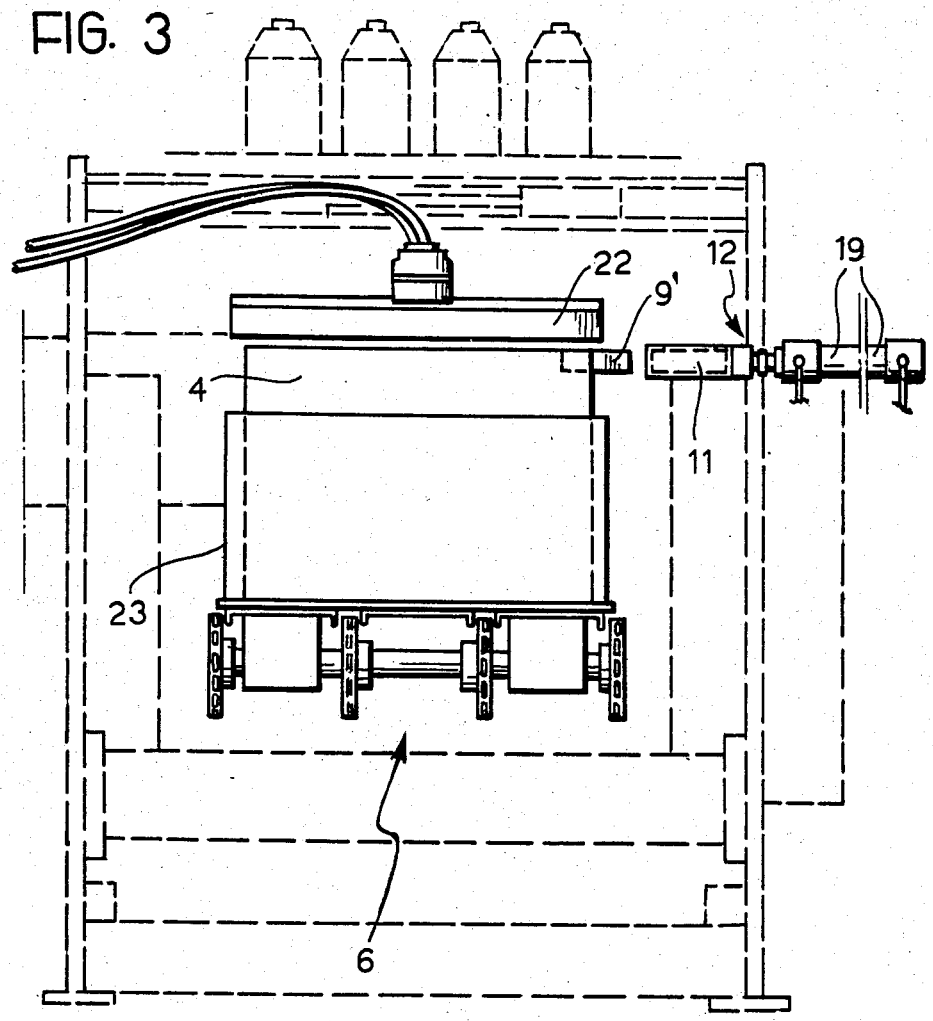
Figure 4:
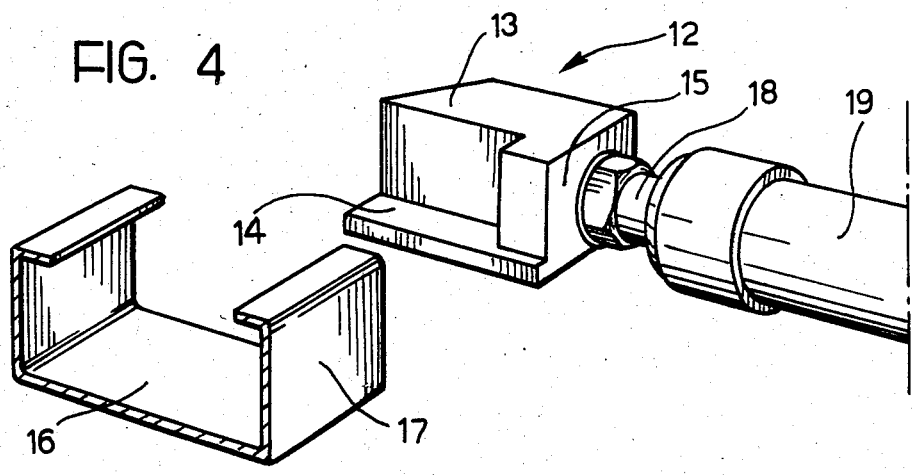
Figure 5:
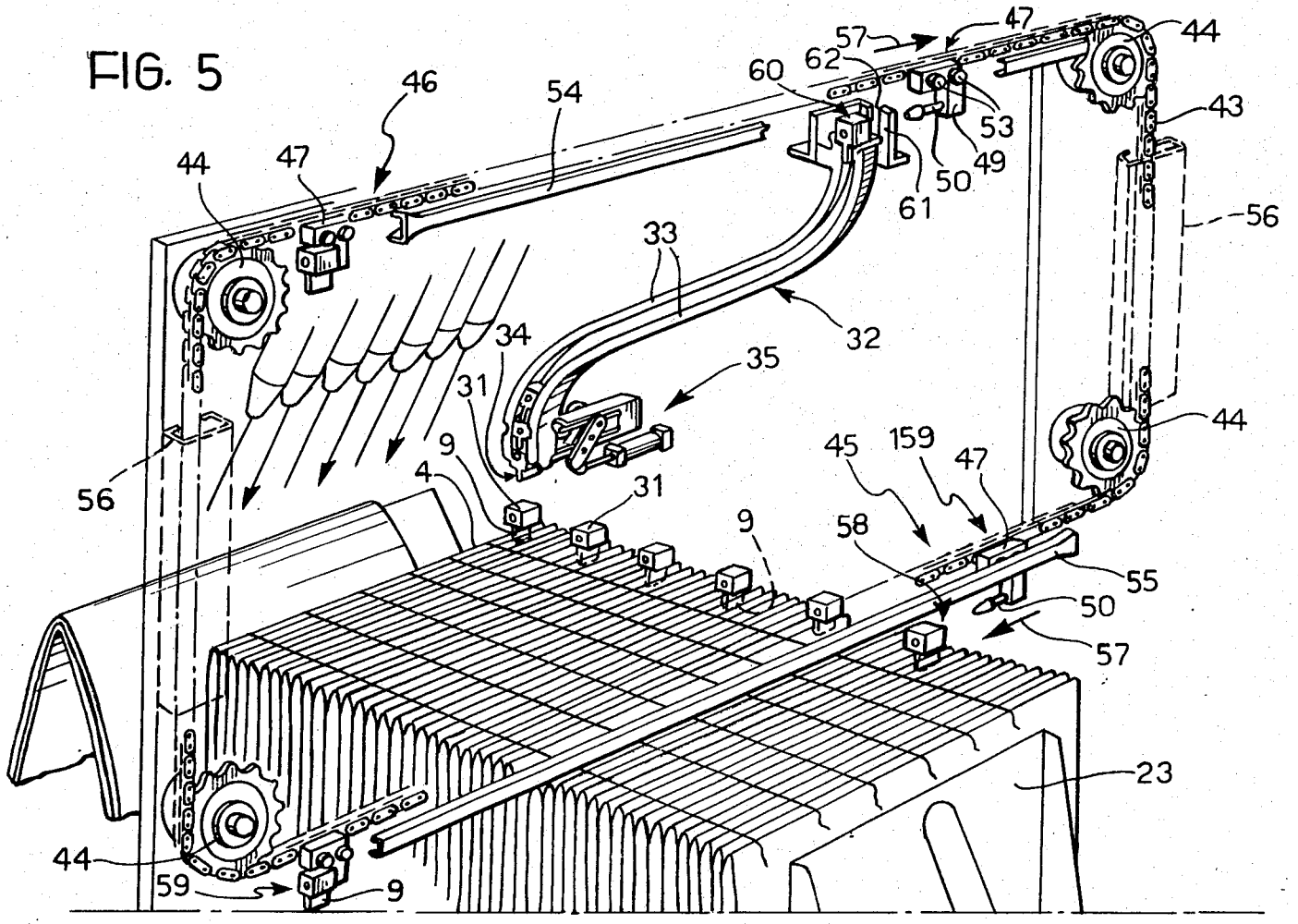
Figure 6:
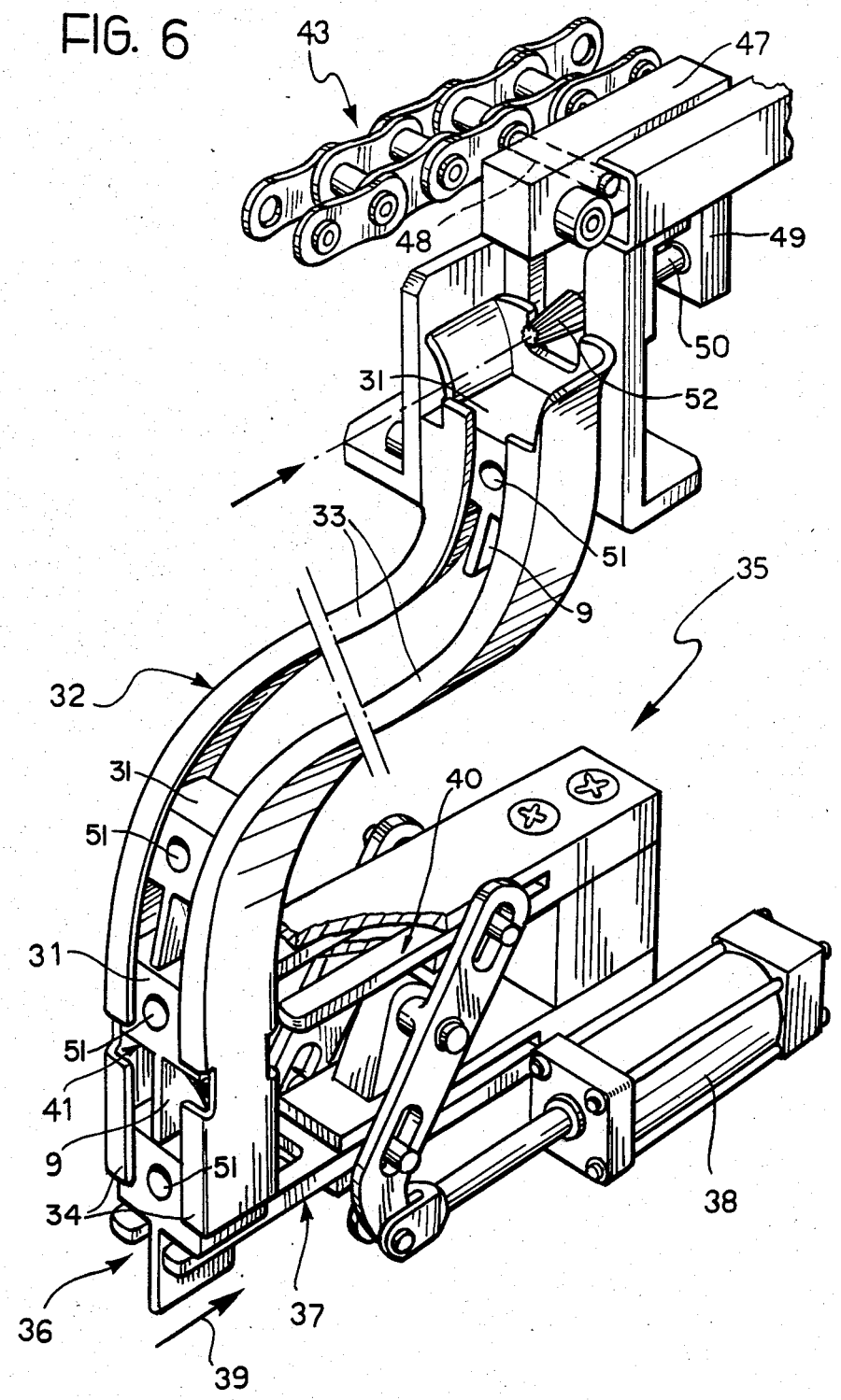
Figure 7:
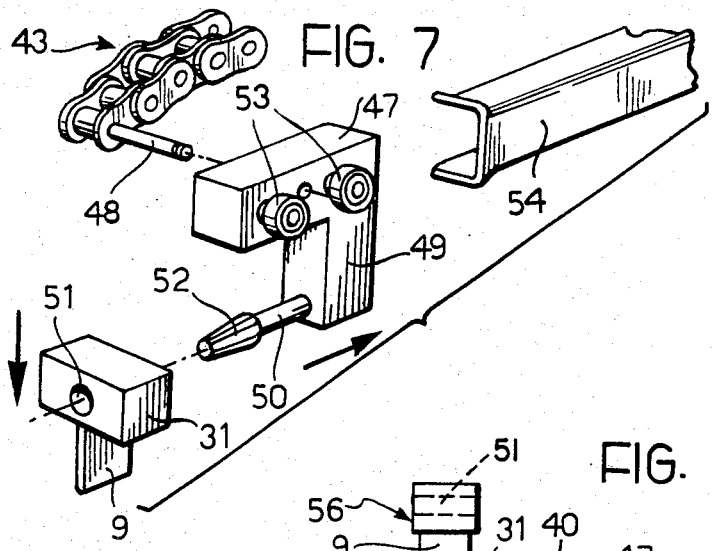

Other characteristics and advantages of the invention will become apparent from the following description with reference to the appended drawings which show, purely schematically, a practical embodiment, and in which:

FIG. 1 is a partial plan schematic view of a book sewing machine according to the invention, FIGS. 2 and 3 are sections taken on lines II—II and III—III of FIG. 1, FIG. 4 is an exploded perspective view showing a constructional detail, FIG. 5 is a schematic partial perspective view showing a constructional variant of the book sewing machine of the invention, FIG. 6 is a perspective view showing, on an enlarged scale, the marker device of the sewing machine illustrated in FIG. 5, FIG. 7 is an exploded perspective view showing a constructional detail of the sewing machine of FIGS. 5 and 6, and FIGS. 8, 9 and 10 are schematic side elevational views of some parts of the marker device, showing the positions adopted thereby during a sequence of three sucessive stages of operation of the device.

In all the drawings, those elements which correspond to each other are indicated by the same reference numerals.

In the drawings (see FIG. 1) the movable saddle of the sewing machine is indicated 1 and a signature arriving at this saddle is indicated 2. The broken line 3 shows the zone of sewing or the plane in correspondence with which groups of tools (not illustrated) which effect the sewing operate, and towards which the top of the saddle carrying the signature 2 is brought to carry the signature 2 close to the rearmost signature 4 of the last of the books already sewn. This book, indicated 5, is carried, together with the previously sewn books, by a horizontal conveyor 6 (see FIGS. 2 and 3) which moves them towards a discharge zone 7.

On one side of the pile of books already sewn carried by the conveyor 6 is the marker device. This includes a loader shaped in the form of an elongate container 8 of rectangular cross section. It carries within it a plurality of indicator elements shaped in the form of rectangular plates 9 made of any material. These plates are constantly thrust towards the open end of the container 8 which is located a small distance from the said plane 3, by the action of a spring 10 which bears against a removable wall 11 which closes the other end of the container itself.

The marker device also includes an inserter member shaped in the form of a slider 12 which partly closes the open end of the container 8 and which has a vertical base wall 13 (see FIG. 4) from the face whereof facing the open end of the loader 8 there project a peripheral lower rib 14 and a peripheral lateral rib 15. The upper face of the rib 14 is aligned with the base 16 of the container 8 and the face of the lateral rib 15 facing the pile of books carried by the conveyor 6 is aligned with the inner face of the side wall 17 of the loader. The slider 12 is connected to the shaft 18 of the double-acting pneumatic actuator 19 fed through a distributor, schematically shown by the small box 20, controlled by a circuit, also shown schematically by the box 21.

At the end of the formation of each book, that is, in the position illustrated in FIG. 1, the circuit 21—which is arranged so as to come into action at the end of each series of oscillations of the movable saddle necessary for the formation of a book—causes the actuation of the pneumatic actuator 19 through the distributor 20. This latter then makes the respective piston (not illustrated) fixed to the shaft 18 carrying the slider 12 effect a movement towards the pile of books carried by the conveyor 7 (up to the position indicated in broken outline in FIG. 1), followed by a return stroke to the starting position illustrated in FIGS. 1 and 4. This cycle of movements of the slider 12 serves to overlay the indicator held against the base wall 13 and the peripheral ribs 14 and 15 of this wall of the slider on the face of the rear signature 4 of the last book 5 facing the sewing zone 3.

The assembly constituted by the container 8 and the slider 12 cooperating therewith is located at a height such that the plate 9 moved towards the pile of books overlies the part of the signature 4 close to the intersection of its back and its side edge facing the loader 8. The base wall 13 of the slider 12 only partly closes the open end of the container 8 and effects a stroke which has a length equal to a fraction of the length of the plate 9. Consequently the plate 9' located over the rear signature 4 of the book 5 projects partially from the side of this book facing the container 8. The position and size of the parts are also such that the upper edge of the plate 9' is located, after its superposition on the signature, at the level of the back of the signature 4. The parts of the backs of the contiguous signatures of the successive books located on the sides of these latter facing the container 8 will thus be spaced apart from each other by a small distance equal to thickness of the plates 9' located therebetween.

At a certain distance from the transverse vertical plane in which the slider 12 slides is a glue spreader 22 of known type, for example a "NORDSON" type arranged to apply a layer of glue to the backs of the books which advance on the conveyor 6 towards the discharge zone 7. This gluer is naturally adjustable so as to adapt it to the requirements of the production of sewn books of different heights.

In the discharge zone 7, at a certain distance from the transverse stop plate 23 for the pile of books brought by the conveyor 6 is the separator mechanism. It includes a blade 24 which lies in a transverse vertical plane spaced from the stop 23 by a distance corresponding to the thickness of a book. The blade is inclined to the horizontal plane touching the backs of the books brought by the conveyor 6 at an angle of about 45° and is located so that its lower end is closer to the side of the pile of books facing the container 8 than its other end, and is located, close to the upper corner of the corresponding side of the pile, substantially above the plate 9' inserted between the rear signature of one book and the first signature of the successive book.

The upper end of the blade 24 is fixed to the shaft of a double acting actuator 25 constituting a replaceable "head" mounted on a horizontal transverse rod 26 which extends beyond the other side of the pile of books and is located at a distance from the stop 23 equal to the thickness of a book. Its end opposite the "head" is fixed to the shaft 27 of another double-acting pneumatic actuator 28 displaced upwardly and towards the sewing zone 3 relative to the rod 26. Beneath the path traversed by the plate 9' inserted between successive books is a photocell 29 the axis of which lies in the transverse plane containing the axis of the rod 26 whereby, when the plate 9' superimposed on the final signature of the book, the first signature of which has reached the stop 23 lies in this plane, the photocell emits a pulse which is transmitted to a circuit 30 which controls the operation of distributors (not illustrated) which control the operation of the pneumatic actuators 25 and 28 so as to cause the component members of the separator to carry out a working cycle:

an axial downward movement of the blade 24 and its penetration between the signatures between which the plate 9', which is lowered, is located;

a successive movement of the "head", due to the operation of the actuator 28 which moves the rod 26 by a distance sufficient to bring the blade 24 from the other side of the horizontal pile of the books;

the return of the pistons (not illustrated) of the actuators 28 and 25 to the starting conditions, which makes the parts resume the position illustrated in FIG. 2.

The first phase of this operation causes the cutting of the layer of glue applied to the backs of the books by the gluer 22 and the cutting of the threads connecting the rear signature of the last book to the first signature of the successive book, thus effecting the separation of the final book.

With the system described above, and with small and relatively inexpensive modifications to conventional sewing machines, one can thus produce books without empty stitches, free from threads projecting from the opposite longitudinal sides of the respective backs, firmly held together by the glueing of these latter and hence ready to pass directly to the trilateral paper cutting machine.

In the embodiment of FIGS. 5 to 10, each of the plates 9 constituting the indicator elements projects from the middle of the lower face of a small parallelepiped shaped block 31 having a square cross-section.

These blocks 31 carrying the plates 9 are made to leave the lower end of a shaped loader 32 one at a time, the loader being located in a position such that each of the plates 9 can overlie the last signature of a book which has already been formed and such that the lower face of the parallelepiped-shaped block 31 from which the plate 9 projects is at the level of the plane in which lie the backs of the signatures in the horizontal pile advancing towards the stop plate 23.

The loader 32 is constituted by two elongate channel-shaped members 33 facing each other. In the lower, vertically-extending end portion 34 of the loader 32 is located the device 35 for controlling the exit of the indicator elements 9, 31 and their location between the successive books formed by the sewing machine. The block 31 of the indicator element 36 (see FIG. 6) located at the bottom of the pile in the loader 32 rests on the fork 37 carried by the device 35.

The fork 37, whose assembly in the device 35 and the system for the control of which by the double-acting pneumatic cylinder 38 are clear from the drawings, particularly FIG. 6, may be withdrawn in the direction of the arrow 39 when a signature counter (not illustrated) emits a signal indicating that the formation of a book has been completed.

Figure 8:
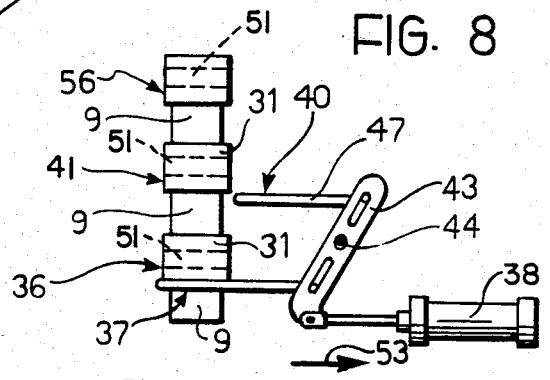
Figure 9:
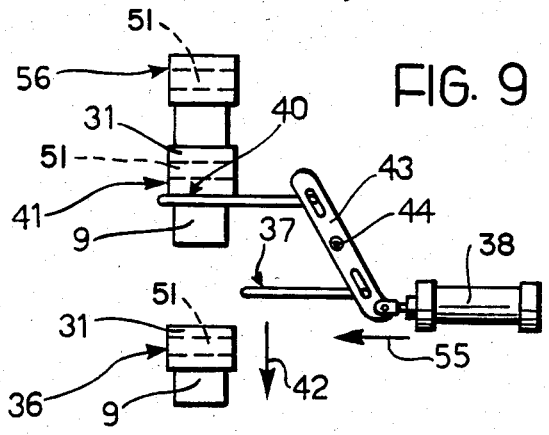
Figure 10:
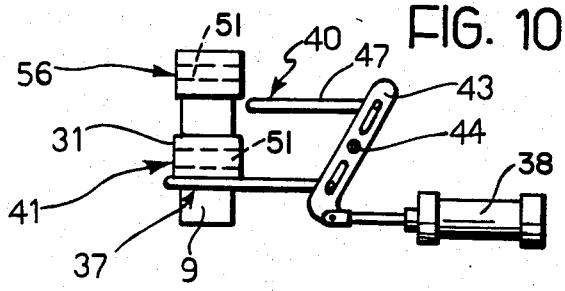

The movement of the fork 37 in the direction mentioned above is accompanied by the movement of the upper fork 40 in the opposite direction, from the position illustrated in FIGS. 6 and 8 to the position illustrated in FIG. 9 in which it is beneath the block 31 of the indicator element 41 located immediately above the element 36. This latter, no longer supported by the fork 37, falls under gravity in the direction of the arrow 42 (see FIG. 9), while the fork 40 prevents the indicator element 41 from descending.

The lower, vertical end portion of the loader 32 is located in a position such as to ensure that the plate 9 of the indicator element 36 overlies that surface of the last signature 4 (see FIG. 5) of the book just formed which faces the sewing zone, in correspondence with that part of this surface closest to the end portion of the respective back which faces the side of the horizontal pile of books in correspondence with which the loader 32 is located.

The upper side part of the first signature of the subsequent book is superimposed immediately on the plate 9 of the indicator element 36 in contact with the last signature of the last book formed so as to prevent it falling downwardly or to the side. The pneumatic actuator 38—under the action of control members (not illustrated) which have been activated by the signature counter—will finally return the forks 37 and 40 to the starting position. This will occur as a result of the passage of the various parts from the position illustrated in FIG. 9 to that illustrated in FIG. 10, the movement of all the indicator elements in the loader 32 downwardly by one step, and the stoppage of the element 41 against the fork 37.

The structure further includes an endless chain 43 (see FIGS. 5, 6 and 7) located in a plane parallel to the stop plate 23. This passes over sprockets 44 mounted on spindles parallel to the direction of advance of the pile, at least one of which is driven by a motor (not illustrated). These spindles are located so that the path of the chain has two horizontal passes, one 45 of which is, disposed close to the plane in which lie the backs of the signatures in the pile which advances towards the stop plate 23 and the other 46 of which is located at such a level as to be above the upper end of the loader 32. In their turn, the lateral vertical passes are located outside the opposite longitudinal sides of the said pile.

The chain 43 (see FIG. 7) carries a plurality of small guide and support carriages 47 rotatably mounted about horizontal pins 48 disposed at regular intervals and all projecting from the same side of the chain 43. Each of these carriages 47 has a lower projection 49 carrying a small rod 50 which can penetrate the through hole 51 formed in the blocks 31 of the indicator elements 9, 31. The resiliently expansible heads 52 of the rods 51 necessitate the use of a certain amount of force to disengage the rods from the holes 51.

The wheels 53 of the carriages 47 cooperate with horizontal and vertical guides 54, 55 and 56 respectively, in order to ensure that the carriages 47 and particularly the rods 50 are always horizontal.

The system further includes a sensor constituted by a microswitch or proximity switch (not illustrated) for outputting a signal when the axis of the through hole 51 formed in the block 31 of one of the indicator elements is in the vertical plane containing the axes of the rods 50.

This event occurs during a stoppage of the pile for sewing thereto of a new signature. The signal output by the sensor activates, through a suitable circuit (not illustrated), the motor which drives the chain 43 and the latter advances in the direction of the arrow 57. During this advance, the rod 50, 52 carried by the projection 49 of that carriage 47 waiting close to the corresponding side of the pile penetrates the hole 51 in the element (generally indicated 58 in FIG. 5) and moves this element to the position occupied by the element indicated 59 also in FIG. 5.

During this movement, the plate 9 of the element 59 cuts the stitches joining two adjacent books in the plane in which the plate moves, and may also cut the layer of glue whenever the latter has already been applied to the backs of the signatures in the pile by a device similar to that indicated 22 in FIGS. 1 and 3 of the drawings.

At the end of the movement of the chain, the intermittent advance of the pile of books towards the stop plate 23 is resumed, and the position 159 occupied previously by a carriage 47 is occupied by the subsequent carriage shown above and to the right in FIG. 5.

In this drawing, the latter is shown in a position just after its disengagement from the indicator element 60, which is stopped by the vertical plate 61 perpendicular to the plane in which the chain 43 lies and provided with a through slot 62 of a width such as to allow the passage of the lower projections 49 of the carriages 47 but not the blocks 31 of the indicator elements. Immediately it is disengaged from the carriage carried by the chain, the element 60 falls into the shaped loader 32 to be added to the top of the pile of indicator elements in the loader.

Naturally, the principle of the invention remaining the same, details may be varied widely with respect to those described above and illustrated in the appended drawings without thereby departing from the scope of the present invention.

Thus, for example, the cutting and separation device could be constituted by a blade movable like a guillotine, that is, in the vertical sense, having its respective cutting edge inclined downwardly towards the side of the pile facing the loader.

The blade 24 could also be replaced by a rod or the like adapted for separating by unstitching. In this case, the sewing machine would still be provided with a normal thread cutter but would be without the spreader for spreading glue onto the respective backs. The overall production line would retain the glueing machine and the advantages achieved would only be those inherent in the elimination of the manual operations of separation and unstitching.

The zone at which the separation is carried out and that in which the photocell for enabling the operation of the separator is disposed could be displaced relative to that illustrated in FIG. 1, as long as it was at a distance from the stop 23 equal to a multiple of the thickness of the books carried by the conveyor 6.

I claim:

1. A book sewing machine of the chain-stitching type, including a sewing zone and a horizontally disposed conveyor having a receiving end disposed adjacent said sewing zone for receiving and for carrying a horizontal pile of vertically disposed books which have been sewn towards a discharge zone, wherein the improvement comprises an automatic mechanism for separating the books already sewn which includes:

a separator member insertable between two contiguous books located close to the discharge zone and displacable in a vertical transverse plane relative to the direction of advance of the conveyor from one side of said conveyor to the other;

a drive device for effecting the insertion and displacement of the separator member, and a control system for said drive device including at least one indicator element:

a marker device including indicator element insertion means disposed adjacent said receiving end of said conveyor for periodically inserting an indicator element in varying relation to the final signature of each book in said conveyor adjacent the sewing zone, close to the top of a vertical side of each book and;

a sensor located close to the path traveled by the indicator element during the advance of the books towards the discharge zone so as to detect the passage of the indicator element and to start the working cycle of the drive device of the separator member when the interval between the backs of the contiguous signature of the books to be separated is in the transverse plane of displacement of the separator member;

said indicator element insertion means includes an inserter member located at one side of the zone of the machine traversed by the books leaving the sewing zone and movable in a horizontal direction perpendicular to the path traveled by the books moved by the conveyor towards the discharge zone;

a circuit sensitive to the number of sewing cycles effected by the machine;

a motor for moving said inserter member in cycles of reciprocating movement in the horizontal direction in response to pulses transmitted by said circuit at the end of the sewing of each book, and a loaded containing a plurality of indicator elements and arranged to feed them one at a time to the inserter member after the termination of each cycle of movements of the inserter member;

wherein the loader is in the form of an elongate container having at least one open end and extending parallel to the longitudinal direction of the conveyor, said open end being adjacent the inserter member, and wherein the inserter member has a base wall disposed transversly of the length of the container, a lateral peripheral rib which spaces the base wall from the open end of the container and projects from the side of this wall opposite the zone in which the conveyor is located, and at least one upper peripheral rib perpendicular to the lateral rib and also spacing the base wall from said open end, the height of said ribs being equal to or slightly greater than thickness of the indicator elements in the loader.

2. A machine as defined in claim 1, wherein the separator member is constituted by a cutting blade, and wherein glueing apparatus for applying a layer of glue to the backs of the vertically disposed books in the horizontal pile carried by the conveyor is located between the blade and the sewing zone.

3. A machine as defined in claim 1, wherein the motor is constituted by a double-acting pneumatic actuator having a shaft connected to the inserter member.

4. A machine as defined in claim 1, wherein the motor is constituted by a double-acting pnuematic actuator having a shaft connected to the lateral peripehral rib projecting from the base wall of the inserter member.

5. A machine as defined in claim 1, wherein the inserter member and the motor are disposed and shaped whereby the indicator elements are overlaid on the top of that vertical side of the final signature of each book already sewn facing the marker device and project partially outwardly beyond this vertical side.

6. A machine as defined in claim 5, wherein the sensor is constituted by a vertical-axis photocell offset in height from the path traveled by the parts of the indicator elements projecting outwardly from the horizontal pile of books advancing on the conveyor and is located in such a position that its axis intersects said path.

7. A machine as defined in claim 1, wherein the container is closed at its end opposite the inserter member and contains a spring which bears against said closed end to thrust the indicator elements in the loader towards the base wall of the inserter member.

8. A machine as defined in claim 7, wherein the indicator elements are constituted by substantially rectangular plates.

9. A machine as defined in claim 1, wherein the separator member is in the form of an elongate member located on one side of said conveyor above the horizontal plane in which the respective backs lie, said member being inclined to the horizontal plane so that its lower end is closer to the pile of books and is at a small distance from the corresponding upper corner of the pile itself, and wherein said drive device includes a first linear motor having a movable element rigid with the elongate member for sliding the latter axially downwardly; a rod located above the horizontal plane and extending beyond the opposite side of the conveyor; a second linear motor having a movable element to which the rod is fixed and being arranged to make the rod traverse a path of a length such as to displace the elongate member to the other side of the pile carried by the conveyor, and a circuit which controls the operation and sequence of movements of said motors, the working cycle of the motors being initiated by a pulse transmitted to said circuit by the sensor.

10. A machine as defined in claim 9, wherein the motors are constituted by double-acting pneumatic actuators.

11. A machine as defined in claim 10, wherein the actuator constituting the second motor is adjacent the rod.

12. A book sewing machine of the chain-stitching type, including a sewing zone and a conveyor horizontally disposed having a receiving end disposed adjacent said sewing zone for receiving and for carrying a horizontal pile of vertically disposed books which have been sewn towards a discharge zone, wherein the improvement comprises an automatic mechanism for separating the books already sewn which includes:

a separator member insertable between two contiguous books located close to the discharge zone and displaceable in a vertical transverse plane relative to the direction of advance of the conveyor from one side conveyor to the other;

a drive device for effecting the insertion and displacement of the separator member, and a control system for said drive device including at least one indicator element:

a marker device including indicator element insertion means disposed adjacent said receiving end of said conveyor for periodically inserting an indicator element in varying relation to the final signature of each book in said conveyor adjacent the sewing zone, close to the top of a vertical side of each book and;

a sensor located close to the path traveled by the indicator element during the advance of the books towards the discharge zone so as to detect the passage of the indicator element and to start the working cycle of the drive device of the separator member when the interval between the backs of the contiguous signatures of the books to be separated is in the transverse plane of displacement of the separator member;

wherein the indicator element also serves as the separator element and comprises a substantially cubic, parallelpipedal block and a plate which projects from the middle of the lower face of the block.

13. A machine as defined in claim 12 further comprising gluing apparatus located between said sewing zone and said sensor for applying a layer of glue to the backs of the vertically disposed books in the horizontal pile carried by said conveyor.

14. A machine as defined in claim 12, wherein said insertion means includes a loader which contains the indicator elements and is constituted by a guide comprising a pair of substantially channel sections having straight upper and lower end portions and a curved intermediate portion, said loader being disposed whereby the lower end portion of the guide is located in a position such that the indicator elements which descend towards the pile of books being formed after their discharge from the loader are superimposed on the respective plate of the last signature of the book just formed.

15. A machine as defined in claim 14, wherein it includes a signature counter and a device for making the indicator elements descend in turn to the sewing zone when the signature counter indicates the completion of a book, said device being located at the lower end of the guide.

16. A machine as defined in claim 15, wherein the device for moving the separator member from one side of said pile to the other include:

an endless chain located in a vertical plane and having a path which includes two horizontal passes—a first located close to the backs of the books in the pile and a second spaced upwardly of to the first—and two intermediate vertical passes located on opposite sides of the pile;

four sprockets rotatable about axes parallel to the length of the pile, over which the chain passes, at least one of the sprockets being driven;

carriages carried at regular intervals by the chain for thrusting the indicator elements acting as separator members from one side of the pile to the other in order to cut the stitches connecting successive books and any layers of glue applied to the books making up the pile, and for returning the indicator elements towards the inlet of the loader, and the sensor outputting a signal when one of the indicator elements whose plate is inserted between two successive books is in a position such as to be engaged by a take-up rod of one of said carriages, the carriages returning the indicator elements towards the inlet of the loader in response to such a signal.

17. A machine as defined in claim 16, wherein each of the carriages is rotatably mounted about a horizontal pin projecting towards one side of, the chain and includes a lower projection carrying the take-up rod engageable in a through-hole defined by the blocks of the indicator elements.

* * * * *